US007250908B2

(12) United States Patent
Lee

(10) Patent No.: US 7,250,908 B2
(45) Date of Patent: Jul. 31, 2007

(54) BEAM STEERING ARRAY ANTENNA METHOD AND APPARATUS

(75) Inventor: Choon Sae Lee, Dallas, TX (US)

(73) Assignee: Southern Methodist University, Dallas, TX (US)

( * ) Notice: Subject to any disclaimer, the term of this patent is extended or adjusted under 35 U.S.C. 154(b) by 162 days.

(21) Appl. No.: 10/846,280

(22) Filed: May 15, 2004

(65) Prior Publication Data

US 2005/0253764 A1 Nov. 17, 2005

(51) Int. Cl.
*H01Q 1/38* (2006.01)
*H01Q 3/00* (2006.01)

(52) U.S. Cl. ..... 343/700 MS; 343/757

(58) Field of Classification Search ..... 343/700 MS, 343/702, 757, 778, 844, 853
See application file for complete search history.

(56) References Cited

U.S. PATENT DOCUMENTS 4,937,585 A * 6/1990 Shoemaker ..... 343/700 MS
6,504,510 B2 * 1/2003 Kim ..... 343/702

* cited by examiner

*Primary Examiner*—Shih-Chao Chen
(74) *Attorney, Agent, or Firm*—Carr LLP

(57) ABSTRACT

Disclosed is an apparatus which reduces the number of phase shifters required in an antenna array. This is accomplished by supplying standing waves from the phase shifters to each of the radiating elements in a column or row. The standing waves in the rows are orthogonal to the standing waves in the columns. Each of the radiating elements combines the applied standing waves, the phases of which determine the angle of the resultant beam.

11 Claims, 3 Drawing Sheets

100

BEAM STEERING ARRAY ANTENNA METHOD AND APPARATUS

TECHNICAL FIELD

The invention relates to an improved beam steering antenna and, more particularly, to an antenna in which one or more standing waves is employed to facilitate the steering.

BACKGROUND

The most common antenna for beam steering or direction finding is a phased-array antenna, in which a phase shifter is used to alter the input phase at each radiating element. Since the cost of each phase shifter is very high, such a prior art phased-array antenna becomes expensive especially when a large number of elements are needed for a high-gain application.

A phased-array antenna steers the beam when used as a transmitter while the antenna as a receiver receives signals as the antenna points to the direction of the incoming signal. The transmitting antenna is identical to the receiving antenna according to the reciprocity theorem.

As will be apparent, such a prior art antenna array with M×N elements requires M×N phase shifters. A need therefore exists for a reduction in the number of phase shifters required to accomplish beam steering. This need is especially critical in antennas using printed circuit stripline technology where phase shifters are very expensive compared to the cost of an antenna array radiating element.

SUMMARY OF THE INVENTION

The present invention comprises providing a supply of one or more standing waves to a set of radiating elements. Each of the radiating elements may simultaneously receive substantially orthogonal standing waves to generate a given direction of output radiation or input reception.

BRIEF DESCRIPTION OF THE DRAWINGS

For a more complete understanding of the present invention, and its advantages, reference will now be made in the following Detailed Description to the accompanying drawings, in which.

DETAILED DESCRIPTION

One method of implementing the teachings of the present invention is to use an array similar to that in FIG. 29 of co-pending U.S. patent application Ser. No. 10/278,252, entitled "Microstrip Array Antenna," filed Oct. 23, 2002, the entirety of which application is incorporated herein by reference for all purposes (hereafter referred to as the "Incorporated Application"). It may be noted that FIG. 3 of this application comprises a portion of FIG. 29 of the Incorporated Application wherein each of the designators originally used are reduced from a 2900-series number to a 300-series number. Likewise, FIGS. 4 and 5 of the present application are substantial copies of FIGS. 30 and 31 of the Incorporated Application. It should be further noted that any reference to FIGS. 1 through 5 in the subsequent material is referring to the present application, not the drawings in the Incorporated Application.

Figure 1:
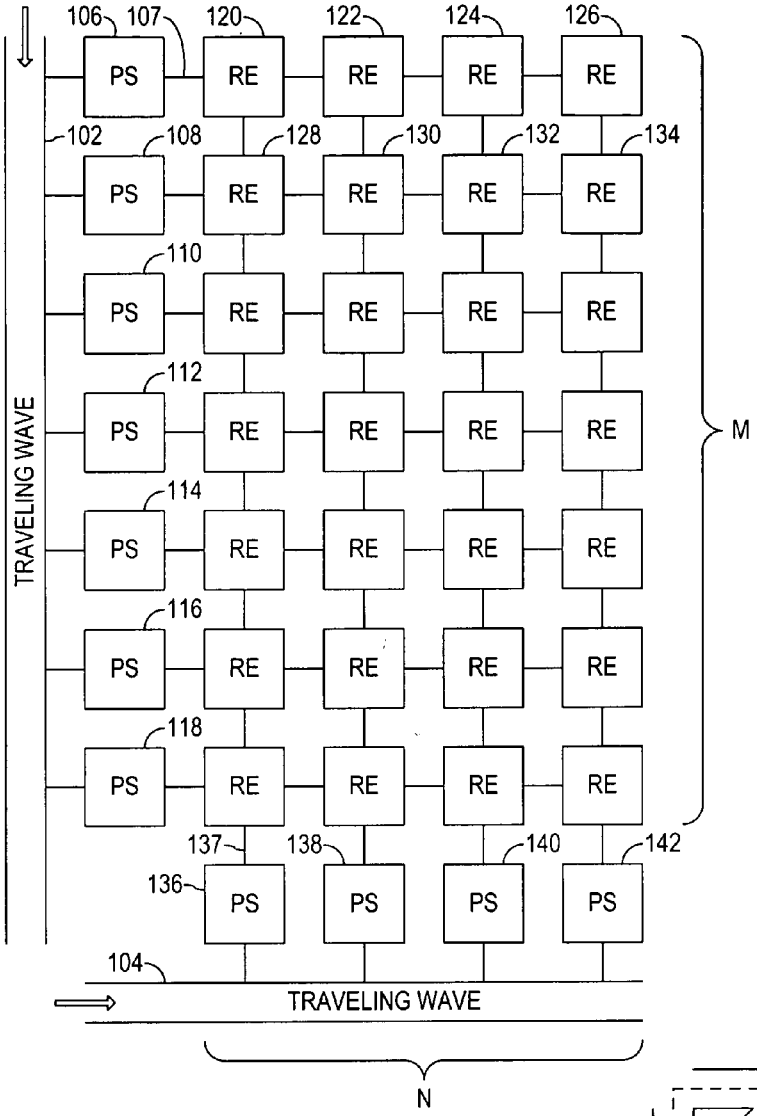
FIG. 1 is a block diagram of an antenna array having radiating elements fed orthogonal standing waves from different sources.

In FIG. 1, an antenna array 100 is shown incorporating two traveling wave signal channels 102 and 104. The traveling waves in the two channels 102 and 104 will be substantially orthogonal. A plurality of phase shifters (PS) 106, 108, 110, 112, 114, 116 and 118 each receive a substantially identical phase traveling wave signal from channel 102. As shown, there are 7 phase shifters in the vertically shown portion of the array. These vertically positioned phase shifters may be referred to as a group of M phase shifters later in this application where M=7. Each of these M phase shifters supply a standing wave to a set of radiating elements (RE). As an example, PS 106 supplies a standing wave to each of 4 REs 120, 122, 124 and 126. These 4 REs may be designated as a set of N where N=4. The adjacent PS 108 supplies a standing wave to each of another set of 4 REs designated as 128, 130, 132 and 134. The standing wave from PS 108 has predetermined phase shift difference as compared to the phase of the standing wave from PS 106. The output from PS 110 is likewise again shifted as compared to the outputs from both PS 106 and 108. As will be mentioned later, the different phases or delta phase shifts for adjacent PSs are utilized in the configuration of the total beam obtained from the antenna array. Such phase shifting to configure a resultant beam from an array is well known in the art and will not be discussed further herein. While FIG. 1 uses an array of 7 by 4 radiating elements, the invention will can be employed with virtually any values of M and N.

The second traveling wave channel 104 supplies a traveling wave signal to a horizontal set of N PSs 136, 138, 140 and 142. Each of these N PSs supply a standing wave signal to a set of M REs. As shown, PS 136 supplies the standing wave to the vertically aligned REs including those numbered 120 and 128. The PS 138, supplies a standing wave to a set of M REs including those designated as 122 and 130. In a manner similar to the previously discussed PSs 106 through 118, the phase of the standing wave signal output by each of the PSs 136 through 142 has a given phase shift as compared to the previous PS in the horizontally aligned set of N PSs. Although, in some embodiments of the invention, the delta or change in phase shift between the outputs of adjacent phase shifters may be identical, in other embodiments the delta may differ somewhat at each adjacent PS in the set.

Figure 2:
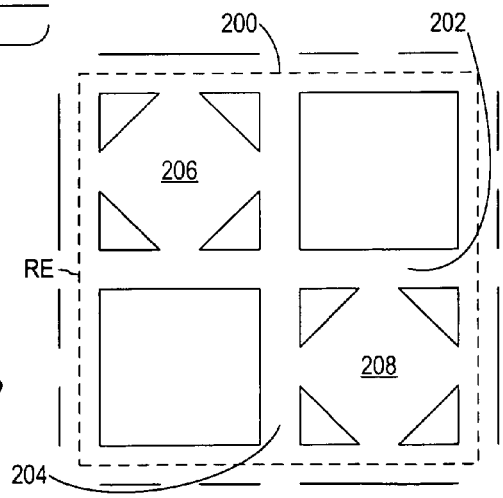
FIG. 2 shows additional detail for a single radiating element of FIG. 1.

In FIG. 29 of the Incorporated Application, an array of interconnected radiating elements is shown. An example of a single RE (radiating element) of the type used in FIG. 29 is shown in FIG. 2 of the present application and designated as 200. A horizontally oriented microstrip feedline 202 supplies a first given phase standing wave to a plurality of adjacent REs as well as to the patches 206 and 208. In a similar manner, the vertically aligned microstrip feedline 204 supplies a second given phase standing wave to a plurality of adjacent REs as well as to the patches 206 and 208. The first and second phase standing waves will typically be substantially orthogonal.

As discussed in the Incorporated Application, the antenna array 2900 of FIG. 29 is designed for dual mode operation. That is, it can both transmit and receive. The use of two traveling wave channels, such as those designated by the designators 326 and 328 in FIG. 3 of the present application permit the antenna, as used in the Incorporated Application, to simultaneously receive and transmit orthogonally oriented signals. The antenna array 2900 however had to be physically oriented to achieve maximum strength reception from a given source.

Figure 3:
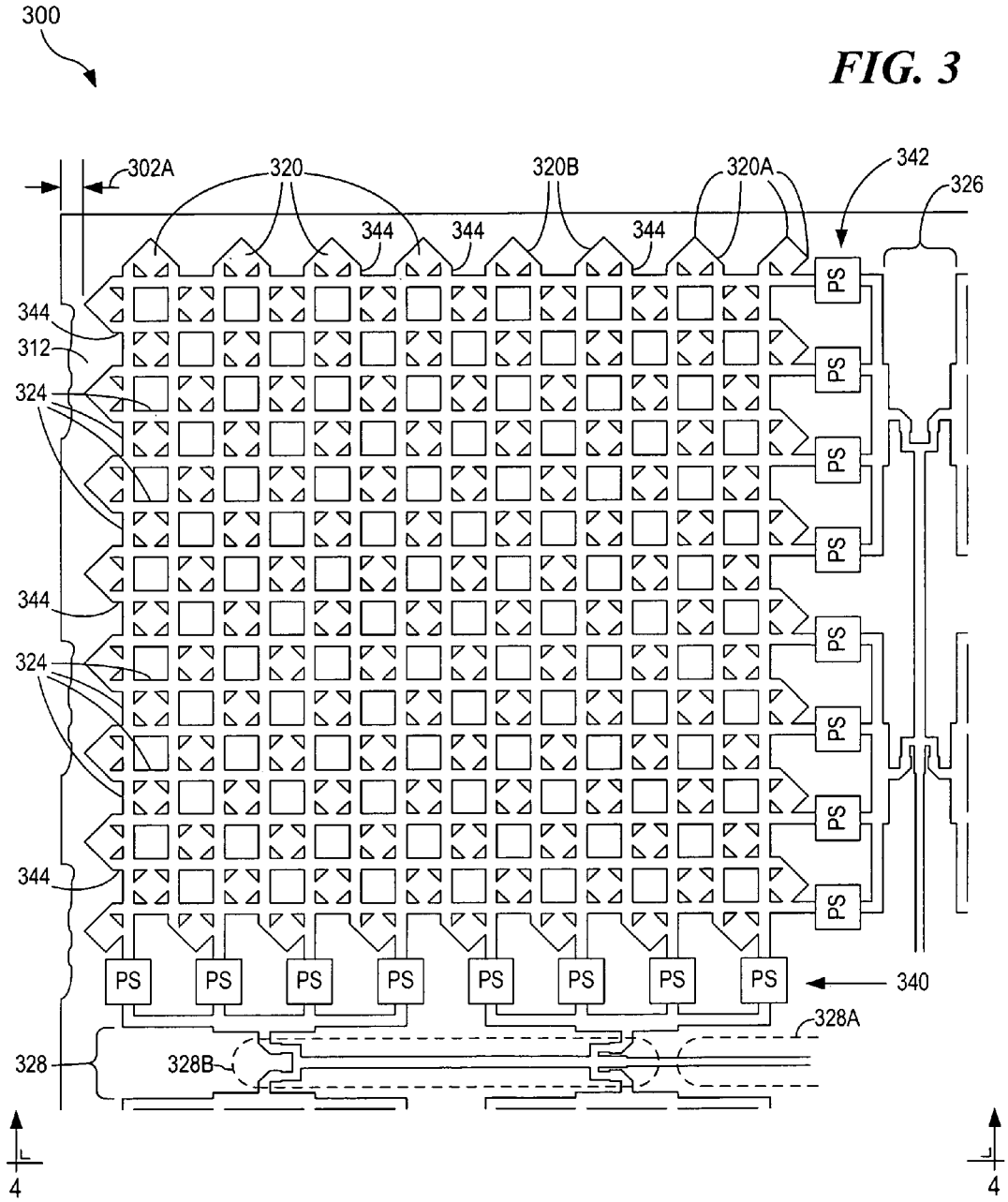
FIG. 3 illustrates more detail of an implementation of the block diagram of FIG. 1 in the form of a flat panel array using microstrip techology.

The physical design of the present invention, need only be changed somewhat from that shown in the Incorporated Application to obtain an antenna array 100 as shown in FIG. 1. This may be accomplished by adding controlled PSs, as shown in FIG. 3. A horizontal set of N PSs is designated as 340 while a vertical set of M PSs is designated as 342. A conductor designated as 344 is shown between each of the sets of REs both vertical and horizontal (columns and rows). This conductor is not shown in FIG. 2. While a traveling wave source is situated on the edge as shown in FIG. 1, a standing wave is formed within the area that contains REs and intermediate conductor 344. The area of standing wave remains the same as that in the Incorporated Application.

It may be noted, in FIG. 3, that there is an indication that further REs may be added to the right and below those shown in FIG. 3. Such additional REs may be used for other signals or may alternatively be used to provide additional directivity. If used, these would typically have to be served by separate PSs.

Figure 4:
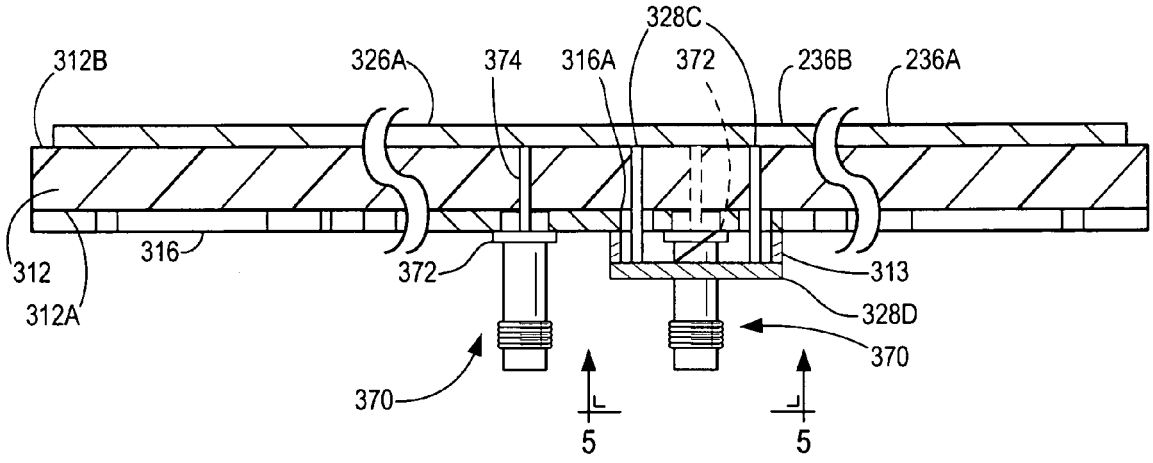
FIG. 4 illustrates a cross section of FIG. 3.
Figure 5:
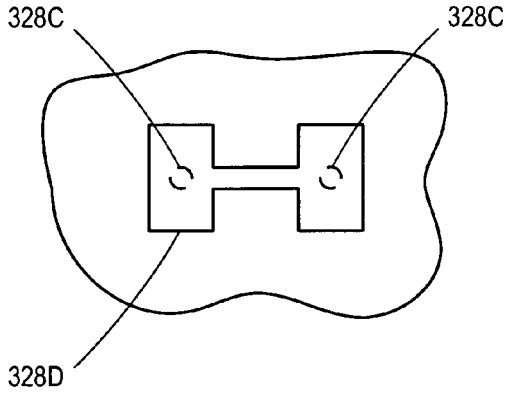
FIG. 5 illustrates a cross section of FIG. 4.

FIGS. 4 and 5 provide more detail on the construction of an array 300 and are substantially duplicates of that shown in FIGS. 30 and 31 of the Incorporated Application. The SMA probes 370 are used to supply signals to and receive signals from the two traveling wave channels 326 and 328. Since the material of FIGS. 4 and 5 are discussed in the Incorporated Application, further discussion of these figures will not be provided.

A flat-panel antenna, such as shown in FIG. 29 of the Incorporated Application, has a dual-operation capability. In other words, the vertical feed line 2926 is independent of the horizontal microstrip feed 2928. Thus, if a linearly polarized (LP) radiation is needed, only one of the feed networks (2926 and 2928) need be used in accordance with the polarization direction desired. Both feed networks are used with a 90-degree phase offset between the networks, to form a circularly polarized (CP) far-field pattern.

Referring to FIG. 1 of the present application, the use of the N phase shifters placed at substantially evenly spaced locations along the horizontal feed line 104 allows the beam to be steered in the horizontal direction. Likewise, the M phase shifters used on the vertical feed line 102 permits the steering of the beam in the vertical direction. In general, this type of arrangement will give only one-dimensional scanning. In order to make two-dimensional scanning possible, the input phase of each radiating element is varied along both vertical and horizontal directions. That is the reason why conventional prior art phased-array antennas require as many phase shifters as the total number of radiating elements.

The antenna 100, however, couples the electromagnetic powers fed from the horizontal and vertical feed lines. Reference may be made to a particular column of array elements such as those fed by PS 136 and including REs 120 and 128. For this column of REs, the input phase in the horizontal direction at each of the REs within the column is provided by the sub-feed line 137 from PS 136. Each of the M PSs from the top PS 106 through the lowest PS 118 provides a different phase output that modulates along the vertical direction. With the illustrated array 100 and phase-shifting design, it is possible to vary the input phase of each radiating element for two-dimensional beam steering.

The fundamental principle of phase modulation from a secondary feed line is as follows. The primary feed from a PS, such as 136, will establish a standing wave along the direction in which the feed line 137 is coming from. By definition, all fields within a resonating cavity are in phase. In other words, there will be no phase variation in at any RE in a given column if each RE is appropriately spaced. When an additional input is provided with a secondary feed line 107, such as that provided by PS 106, there will be another standing wave formed, in which all fields are in phase. Those two standing waves exist within the same physical area but with different phases depending on the phases of the primary and secondary feeds. By the term "same physical area", reference is being made to the patches within RE 120. When those two fields are combined to produce radiation at a patch, such as 206 or 208 (FIG. 2), in this element, there will be phase variation along or in both horizontal and vertical directions.

By changing the phase of each adjacent PS, the resultant beam can be configured to a desired shape. The angle of this resultant beam, with respect to an imaginary vertical line extending from the center of the antenna array 100 is determined by the relative phase of two traveling waves 102 and 104 supplying signals to the M and N sets of PSs. When the phases of the two traveling wave signals 102 and 104 are swept over a predetermined range, the resultant signal beam is swept over a given range of angles with respect to the previously mentioned vertical line.

As mentioned above, the prior art requires the product of M times N phase shifters for an antenna array of M radiating elements in a first direction and N elements in a second direction. The present invention, however, only requires the sum of M+N phase shifters for the same size antenna array.

This is accomplished by supplying standing waves from the phase shifters to each of the radiating elements in a column or row. The standing waves in each of the rows are orthogonal to the standing waves in each of the columns. Each of the individual radiating elements combines the applied standing waves to produce a resultant beam. The phases of the two applied standing waves determine the angle of the resultant beam.

Although the description so far has utilized a flat panel array using printed circuit microstrip techniques in the manufacture thereof, the invention applies to any shape of array such as curved. Further the invention applies to any type of construction of an array where the elements can combine received standing waves to generate an output beam that deviates from an imaginary line vertical the face of the radiating elements.

Although the invention has been described with reference to a specific embodiment, the description is not meant to be construed in a limiting sense. Various modifications of the disclosed embodiment, as well as alternative embodiments of the invention, will become apparent to persons skilled in the art upon reference to the description of the invention. It is therefore contemplated that the claims will cover any such modifications or embodiments that fall within the true scope and spirit of the invention.

What is claimed is:

1. A phased array flat panel antenna comprising:

a plurality of M sets of radiating elements, wherein each of said M sets is spaced apart and aligned in a first direction;

a plurality of N sets of radiating elements, wherein each of said N sets is spaced apart and aligned in a second direction that is in a substantially quadrature relationship with said first direction;

a plurality M of phase shifters, each of said M phase shifters directly supplying signals of a near similar, but different, phase to at least one of said sets of N radiating elements;

a plurality N of phase shifters, each of said N phase shifters directly supplying signals of a near similar, but different, phase to at least one of said sets of M radiating elements; and wherein each radiating element is concurrently fed by a first feedline and a second feedline in which the first feedline and the second feedline are independent of each other.

2. The phased array flat panel antenna of claim 1, wherein said each radiating element is designed such that said each radiating element takes one mode for radiation out of two substantially orthogonal modes from standing waves formed at a feed network.

3. A phased array flat panel antenna comprising:

a plurality of radiating elements, said radiating elements formed in a substantially rectangular array of M sets of elements in a first direction and N sets of elements in a second direction;

a plurality M of phase shifters, each of said M phase shifters directly supplying signals to a different set of N radiating elements in said rectangular array;

a plurality N of phase shifters, each of said N phase shifters directly supplying signals to a different set of M radiating elements in said rectangular array; and wherein each radiating element is concurrently fed by a first feedline and a second feedline in which the first feedline and the second feedline are independent of each other.

4. A method of generating a beam steered signal from an antenna array of M by N sets of radiating elements comprising the steps of:

directly supplying M sets of standing wave signals to each of N sets of radiating elements;

directly supplying N sets of standing wave signals to each of M sets of radiating elements; and wherein each radiating element is concurrently fed by a first feedline and a second feedline in which the first feedline and the second feedline are independent of each other.

5. The method of claim 4 further comprising positioning each of said M sets of standing wave signals substantially orthogonal to said N sets of standing wave signals.

6. The method of claim 5 wherein said positioning step further comprises positioning said radiating elements in a flat panel antenna array.

7. The method of claim 4, further comprising combining the forces of said two standing waves received by each radiating element to produce a resultant beam which deviates from an imaginary line vertical to said array.

8. A phased array antenna comprising:

a plurality of radiating elements formed in an array of M sets of elements in a first direction and N sets of elements in a second direction;

a plurality M of phase shifters, each of said M phase shifters supplying standing wave signals to a different set of N radiating elements in said array;

a plurality N of phase shifters, each of said N phase shifters supplying standing wave signals to a different set of M radiating elements in said array; and wherein each radiating element is concurrently fed by a first feedline and a second feedline in which the first feedline and the second feedline are independent of each other.

9. The phased array antenna of claim 8, wherein said each radiating element is designed such that said each radiating element takes one mode for radiation out of two substantially orthogonal modes from standing waves formed at a feed network.

10. A phased array flat panel antenna comprising:

a plurality of (M×N) radiating elements formed in an array of M elements in a first direction and N elements in a second direction;

a plurality M+N phase shifters, said M+N phase shifters operating to supply signals to all of said M×N radiating elements to form a composite signal beam at an angle deviating from an imaginary vertical line extending from said panel;

wherein each M phase shifter directly supplies a signal to a different array of N radiating elements and each N phase shifter directly supplies a signal to a different array of M radiating elements; and wherein each radiating element is concurrently fed by a first feedline and a second feedline in which the first feedline and the second feedline are independent of each other.

11. A phased array antenna having an array of M rows and N columns of radiating elements, comprising:

a plurality M of phase controllable standing wave sources, each of said M phase controllable standing wave sources supplying standing wave signals to each of the radiating elements in a different row of N radiating elements in said array;

a plurality N of phase controllable standing wave sources, each of said N phase controllable standing wave sources supplying standing wave signals to each of the radiating elements in a different column of M radiating elements in said array; and wherein each radiating element is concurrently fed by a first feedline and a second feedline in which the first feedline and the second feedline are independent of each other.

* * * * *